US011587722B2

(12) United States Patent
Yang et al.

(10) Patent No.: US 11,587,722 B2
(45) Date of Patent: Feb. 21, 2023

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byung Soo Kang, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 691 days.

(21) Appl. No.: 16/287,408

(22) Filed: Feb. 27, 2019

(65) Prior Publication Data

US 2020/0027649 A1 Jan. 23, 2020

(30) Foreign Application Priority Data

Jul. 18, 2018 (KR) ..... 10-2018-0083387

(51) Int. Cl.
*H01F 27/29* (2006.01)
*H01F 27/28* (2006.01)
(Continued)

(52) U.S. Cl.
CPC ..... *H01F 27/29* (2013.01); *H01F 27/02* (2013.01); *H01F 27/288* (2013.01);
(Continued)

(58) Field of Classification Search
CPC combination set(s) only.
See application file for complete search history.

(56) References Cited

U.S. PATENT DOCUMENTS 6,853,268 B2 * 2/2005 Harada ..... H01P 1/23 333/185
7,161,446 B2 * 1/2007 Uchida ..... H01F 17/0013 333/185
(Continued)

FOREIGN PATENT DOCUMENTS

CN 201051443 Y 4/2008
CN 201421774 Y 3/2010
(Continued)

OTHER PUBLICATIONS

Office Action issued in Korean Application No. 10-2018-0083387 dated Aug. 19, 2019, with English translation.
(Continued)

*Primary Examiner* — Mang Tin Bik Lian
(74) *Attorney, Agent, or Firm* — Morgan, Lewis & Bockius LLP

(57) ABSTRACT

A coil component includes a body having one surface and the other surface opposing each other in one direction, and a plurality of walls each connecting the one surface to the other surface; a coil portion buried in the body, and having both ends exposing to one of the plurality of walls of the body; first and second external electrodes respectively including first and second terminal electrodes disposed on one surface of the body and spaced apart from each other, and first and second connection electrodes respectively connecting the first and second terminal electrodes to both ends of the coil portion; a first external insulating layer disposed on the other surface of the body; and a first shielding layer disposed on the external insulating layer.

16 Claims, 11 Drawing Sheets

(51) Int. Cl.
*H01F 27/02* (2006.01)
*H01F 27/36* (2006.01)

(52) U.S. Cl.
CPC ..... *H01F 27/361* (2020.08); *H01F 27/363* (2020.08); *H01F 27/366* (2020.08)

(56) References Cited

U.S. PATENT DOCUMENTS 9,230,728 B2 * 1/2016 Liu ..... H01F 27/2828
2004/0017280 A1 * 1/2004 Yamamoto ..... H01F 27/255 336/234
2006/0038651 A1 * 2/2006 Mizushima ..... H01F 17/04 336/83
2012/0133472 A1 5/2012 Nishikawa et al.
2012/0313729 A1 * 12/2012 Togashi ..... H03H 7/425 333/24 R
2013/0169399 A1 * 7/2013 Yoo ..... H01F 17/0013 427/125
2013/0200958 A1 * 8/2013 Satake ..... H03H 7/463 333/12
2013/0255071 A1 * 10/2013 Muneuchi ..... H01F 41/02 29/605
2013/0307655 A1 * 11/2013 Saito ..... H01F 17/043 336/83
2014/0068926 A1 * 3/2014 Saito ..... H01F 41/127 29/602.1
2014/0366365 A1 * 12/2014 Sasamori ..... H01F 41/0246 29/605
2015/0048915 A1 2/2015 Yoon et al.
2016/0189840 A1 * 6/2016 Ahn ..... H01F 17/04 29/602.1
2016/0240296 A1 * 8/2016 Kim ..... H01F 17/04
2016/0268038 A1 * 9/2016 Choi ..... H01F 27/255
2017/0092410 A1 * 3/2017 Sado ..... H01F 27/306
2017/0110240 A1 * 4/2017 Masuda ..... H01F 17/0013
2017/0200682 A1 * 7/2017 Lin ..... H01L 24/97
2017/0256353 A1 9/2017 Park et al.
2017/0271081 A1 9/2017 Maki et al.
2017/0301458 A1 * 10/2017 Mimura ..... H01F 17/0006
2017/0365402 A1 * 12/2017 Fukushima ..... H01F 17/0013
2018/0096783 A1 * 4/2018 Fukuda ..... H01F 27/346
2018/0130596 A1 * 5/2018 Yamaguchi ..... H01F 27/2804
2018/0166200 A1 6/2018 Lu et al.
2018/0166211 A1 * 6/2018 Takatsuji ..... H02M 3/156
2018/0182537 A1 * 6/2018 Shimizu ..... H01F 27/292
2018/0350499 A1 * 12/2018 Matsuura ..... H01G 4/232
2019/0228906 A1 * 7/2019 Miyahara ..... H01F 27/2804
2019/0348214 A1 * 11/2019 Tobita ..... H01F 27/292
2019/0379343 A1 * 12/2019 Miyahara ..... H03H 1/00

FOREIGN PATENT DOCUMENTS

CN 202058571 U 11/2011
CN 106716566 A 5/2017
CN 107004493 A 8/2017
CN 108183017 A 6/2018
CN 108231337 A 6/2018
JP 2005-310863 A 11/2005
JP 2012-114363 A 6/2012
JP 2014-049598 * 3/2014
JP 2014-175437 * 9/2014
JP 2015220272 A * 12/2015
JP 2017-076796 A 4/2017
JP 2018-98270 A 6/2018
KR 10-2015-0019730 A 2/2015
KR 10-2016-0099882 A 8/2016

OTHER PUBLICATIONS

Chinese Office Action dated Feb. 11, 2022, issued in corresponding Chinese Patent Application No. 201910396160.5 (with English Translation).

* cited by examiner

III-III'

IV-IV'

COIL COMPONENT

CROSS-REFERENCE TO RELATED APPLICATION(S)

This application claims the benefit of priority to Korean Patent Application No. 10-2018-0083387 filed on Jul. 18, 2018 in the Korean Intellectual Property Office, the disclosure of which is incorporated herein by reference in its entirety.

1. TECHNICAL FIELD

The present disclosure relates to a coil component.

2. BACKGROUND

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

Accordingly, there has been increasing demand for removing a factor causing noise such as electromagnetic interference (EMI) in electronic components.

A currently used EMI shielding technique is, after mounting electronic components on a substrate, to envelop the electronic components and the substrate using a shielding can.

SUMMARY

An aspect of the present disclosure is to provide a coil component having a reduced size and thickness.

Another aspect of the present disclosure is to provide a coil component in which an electrode structure may be easily formed on a lower surface.

Another aspect of the present disclosure is to provide a coil component in which a shielding structure capable of reducing a magnetic flux leakage may be easily formed.

According to an aspect of the present disclosure, a coil component includes a body having one surface and the other surface opposing each other in one direction, and a plurality of walls each connecting the one surface to the other surface; a coil portion buried in the body, and having both ends exposing to one of the plurality of walls of the body; first and second external electrodes respectively including first and second terminal electrodes disposed on one surface of the body and spaced apart from each other, and first and second connection electrodes respectively connecting the first and second terminal electrodes to both ends of the coil portion; a first external insulating layer disposed on the other surface of the body; and a first shielding layer disposed on the external insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
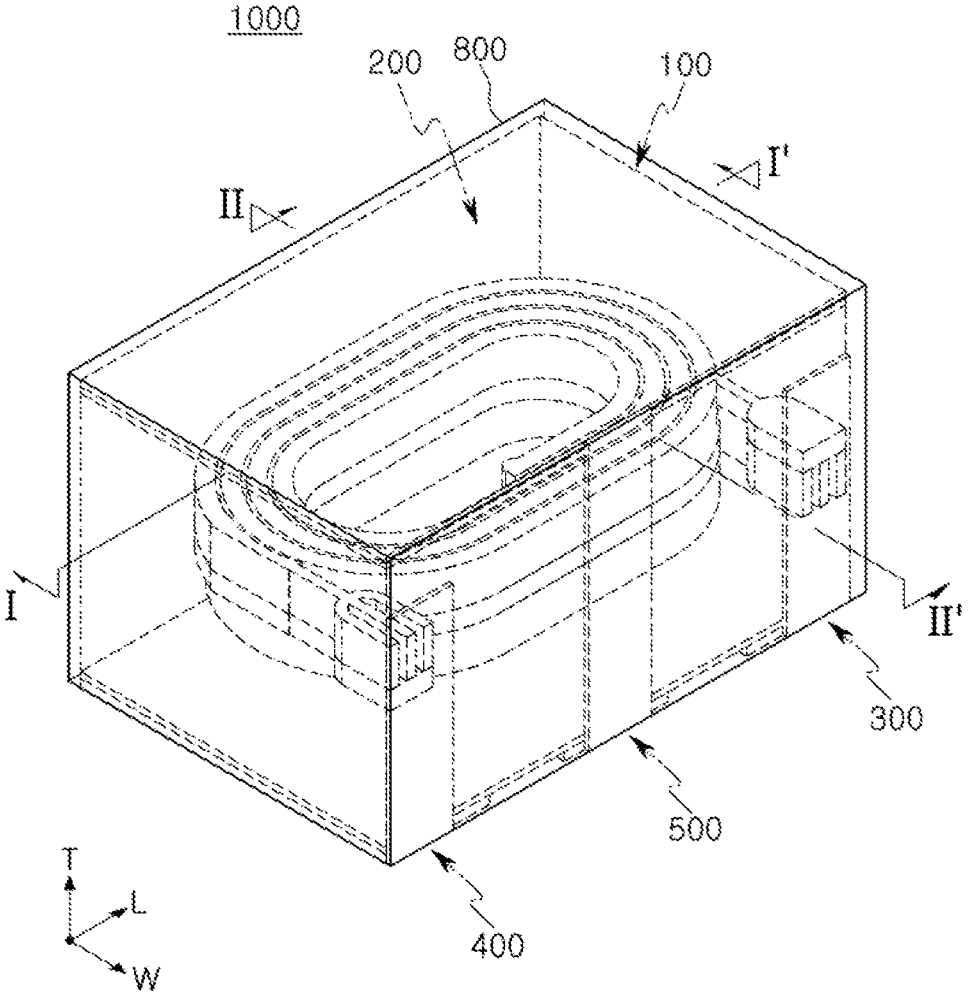
FIG. 1 is a schematic perspective diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or below an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
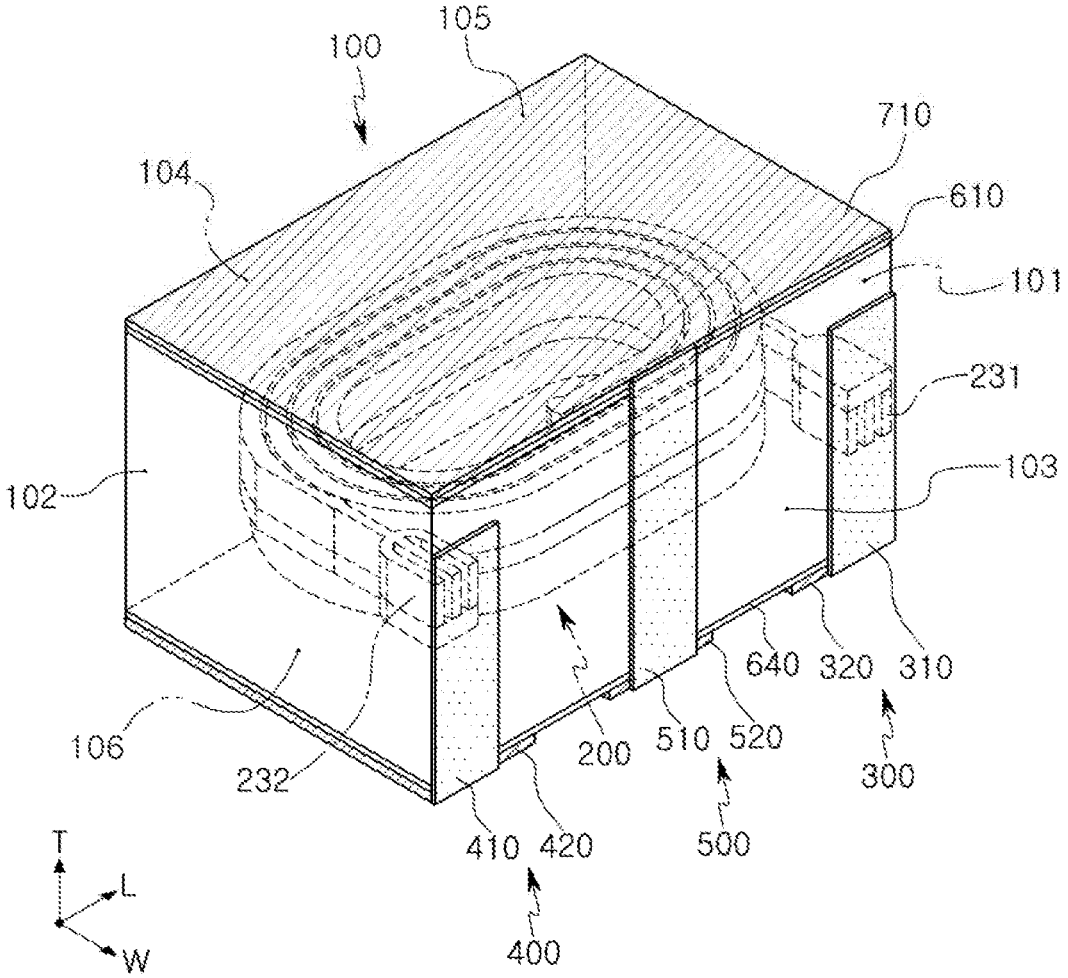
FIG. 2 is a diagram illustrating a coil component in which some of elements illustrated in FIG. 1 are omitted.
Figure 3:
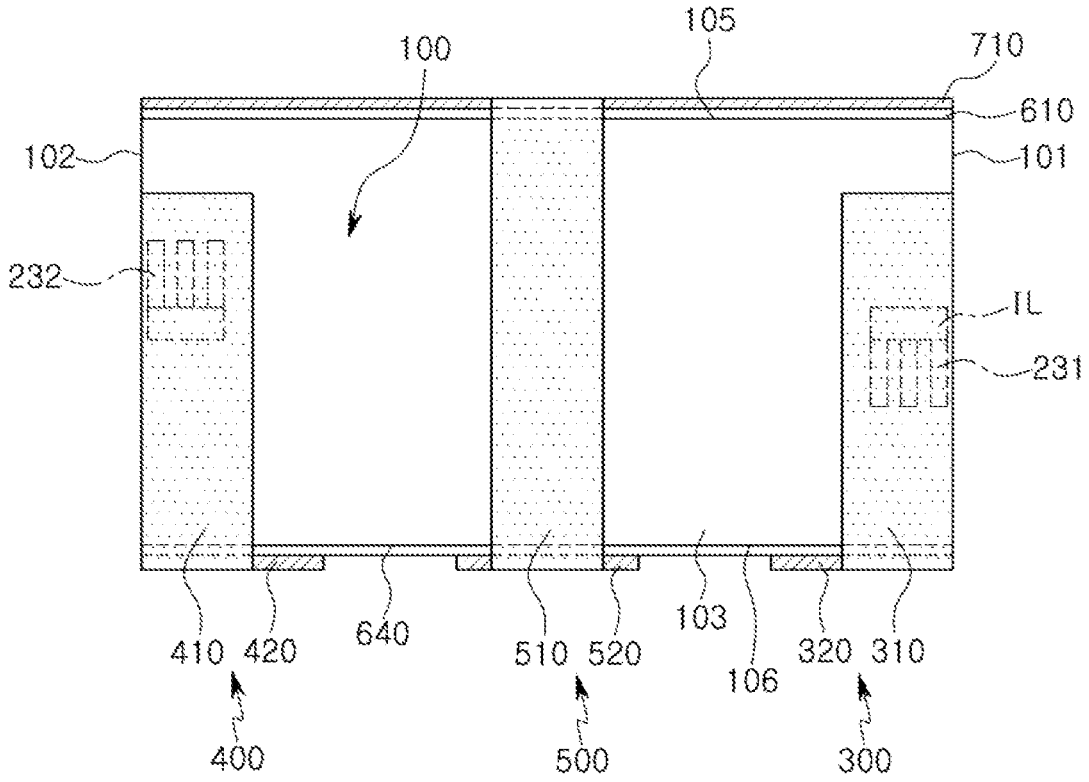
FIG. 3 is a diagram illustrating a third surface of a body illustrated in FIG. 2.
Figure 4:
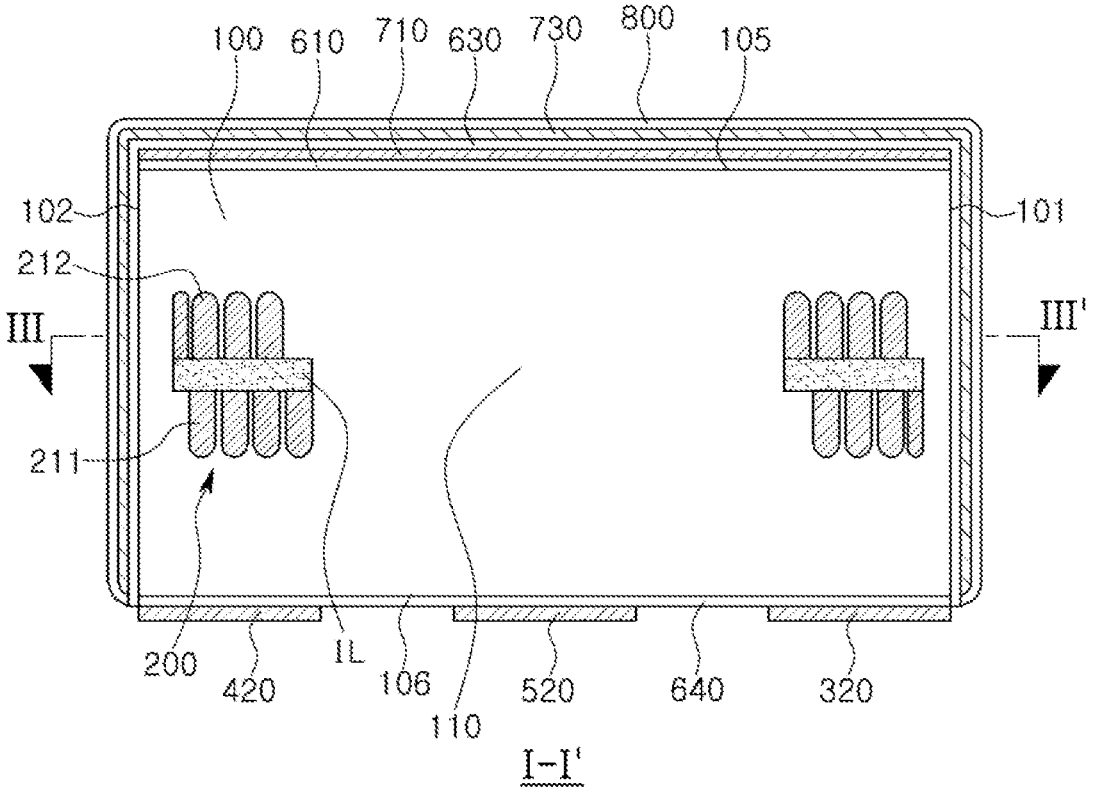
FIG. 4 is a cross-sectional diagram taken along line I-I' in FIG. 1.
Figure 5:
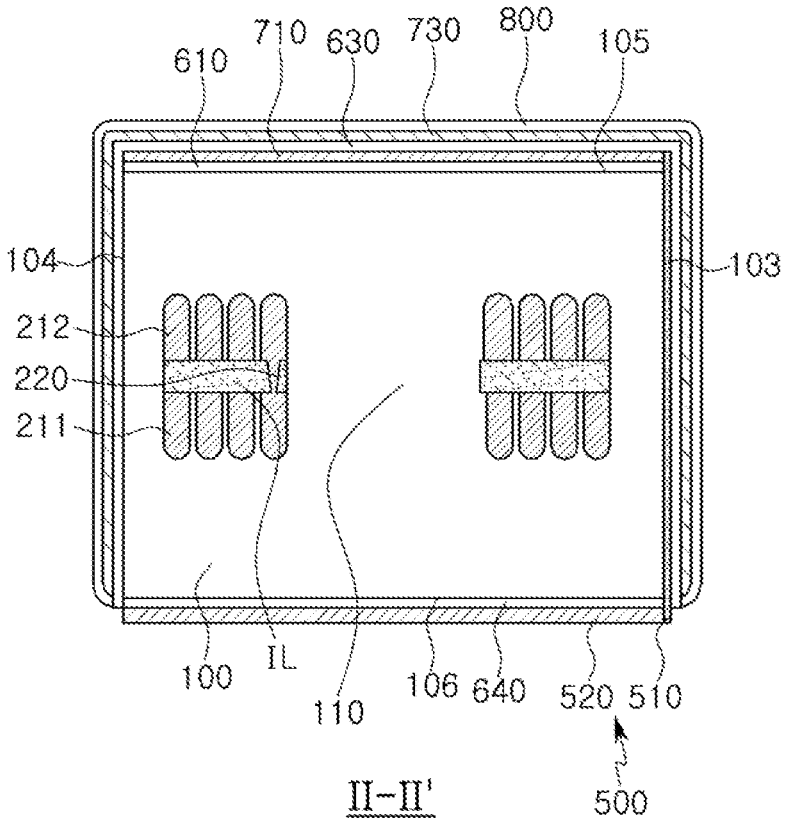
FIG. 5 is a cross-sectional diagram taken along line II-II' in FIG. 1.
Figure 6:
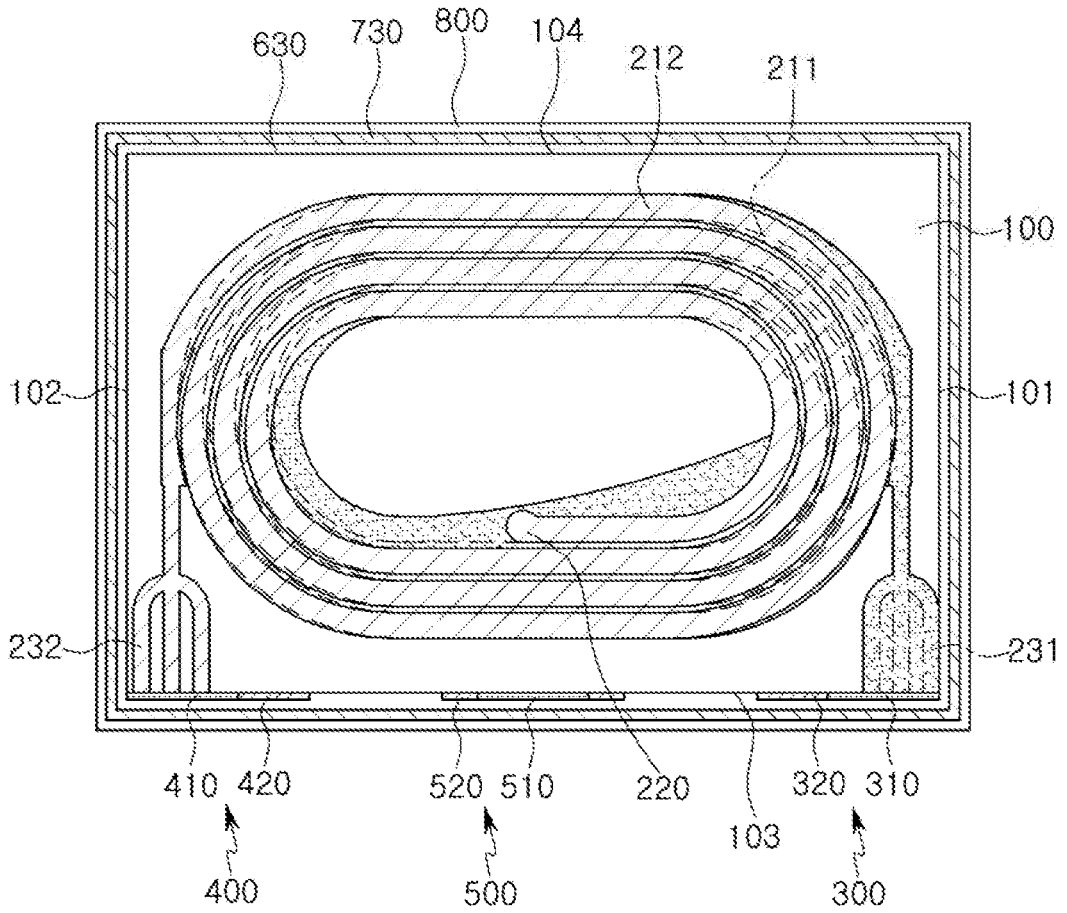
FIG. 6 is a cross-sectional diagram taken along line III-III' in FIG. 4.

FIG. 1 is a schematic perspective diagram illustrating a coil component according to an exemplary embodiment. FIG. 2 is a diagram illustrating a coil component in which some of elements illustrated in FIG. 1 are omitted. FIG. 3 is a diagram illustrating a third surface of a body illustrated in FIG. 2. FIG. 4 is a cross-sectional diagram taken along line I-I' in FIG. 1. FIG. 5 is a cross-sectional diagram taken along line II-II' in FIG. 1. FIG. 6 is a cross-sectional diagram taken along line III-III' in FIG. 4. With regard to FIG. 2, FIG. 2 illustrates the coil component in which a cover insulating layer 630, a third shielding layer 730, and a cover layer 800 are omitted.

Referring to FIGS. 1 to 6, a coil component 1000 according to the exemplary embodiment may include a body 100, a coil portion 200, external electrodes 300, 400, and 500, external insulating layers 610 and 640, shielding layers 710 and 730, and a cover insulating layer 640, and may further include an internal insulating layer IL.

The body 100 may form an exterior of the coil component 1000, and may bury the coil portion 200 in the body 100.

The body 100 may have a hexahedral shape.

Referring to FIG. 2, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 on which the external electrodes 300, 400, and 500 are formed may have a length of 2.0 mm, a width of 1.2 mm, and a thickness of 0.65 mm, but an exemplary embodiment of the coil component 1000 is not limited thereto. In one embodiment, the length of the coil component 1000 is 1.9 mm, 1.8 mm, 1.7 mm, 1.6 mm, or 1.5 mm. In one embodiment, the width of the coil component 1000 is 1.1 mm, 1.0 mm, 0.9 mm, 0.0 mm, 0.7 mm, or 0.6 mm. In one embodiment, the thickness of the coil component is 0.60 mm, 0.55 mm, 0.50 mm, 0.45 mm, 0.40 mm, 0.35 mm, or 0.30 mm.

The body 100 may include a magnetic material and a resin material. For example, the body 100 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as an yttrium (Y) ferrite, and a lithium (Li) ferrite.

The magnetic metal powder may include one or more materials selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto. In one embodiment, the average diameter of the ferrite or the magnetic metal powder is 0.5 μm, 1 μm, 5 μm, 10 μm, 15 μm, 20 μm, or 25 μm.

The body 100 may include two or more types of magnetic materials dispersed in a resin. The notion that types of the magnetic materials are different may indicate that one of an average diameter, a composition, crystallinity, and a form of one of magnetic materials is different from those of the other magnetic material.

The resin may include one of an epoxy resin, a polyimide, a liquid crystal polymer, or mixture thereof, but the example of the resin is not limited thereto.

The body 100 may include a core 110 penetrating through a coil portion 200, which will be described later. The core 110 may be formed by filling a through hole of the coil portion 200, but an exemplary embodiment thereof is not limited thereto.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine via may be formed.

The coil portion 200 may be buried in the body 100, and may embody properties of the coil component. For example, when the coil component 1000 is used as a power inductor, the coil portion 200 may store an electric field as a magnetic field such that an output voltage may be maintained, thereby stabilizing power of an electronic device.

The coil portion 200 may include first and second coil patterns 211 and 212, first and second lead-out portions 231 and 232, and a via 220, and the first and second coil patterns 211 and 212, the first and second lead-out portions 231 and 232, and the via 220 may be connected to one another and may collectively function as one coil.

For example, referring to FIGS. 1 to 5, the first coil pattern 211 and the first lead-out portion 231 may be disposed on a lower surface of the internal insulating layer IL opposing the sixth surface 106 of the body 100, and the second coil pattern 212 and the second lead-out portion 232 may be disposed on an upper surface of the internal insulating layer IL opposing a lower surface of the internal insulating layer IL. The first and second lead-out portions 231 and 232 may respectively correspond to ends of the first and second coil patterns 211 and 212, and may be in contact with and connected to the first and second connection electrodes 310 and 410 of the first and second external electrodes 300 and 400. The via 220 may penetrate through the internal insulating layer IL and may respectively be in contact with the first coil pattern 211 and the second coil pattern 212 and may connect the first coil pattern 211 and the second coil pattern 212 to each other.

The first coil pattern 211 and the second coil pattern 212 each may have a planar spiral shape forming at least one turn centering on the core 110 as an axis. For example, the first coil pattern 211 may form at least one turn on a lower surface of the internal insulating layer IL centering on the core 110 as an axis.

The first and second lead-out portions 231 and 232 may extend to and be exposed to one of the plurality of walls of the body 100 from the first and second coil patterns 211 and 212. For example, referring to FIGS. 1 to 6, the first and second lead-out portions 231 and 232 may extend to the third surface 103 of the body 100 from the first and second coil patterns 211 and 212, and may be exposed together to the third surface 103 of the body 100 while being spaced apart from each other. Thus, the structure in the exemplary embodiment may be different from a general coil structure in which the first and second lead-out portions 231 and 232 extend to two walls of a body opposing each other.

The first and second lead-out portions 231 and 232 each may include one or more silts. As an example, the first lead-out portion 231 may include two silts such that the first lead-out portion 231 may have a shape similar to a fork as illustrated in FIG. 6 and other diagrams. When the slits are formed in the first and second lead-out portions 231 and 232, a contact area between the first and second lead-out portions 231 and 232 and the body 100 may increase. Accordingly, cohesion force between the coil portion 200 and the body 100 may improve.

At least one of the first and second coil patterns 211 and 212, the via 220, and the first and second lead-out portions 231 and 232 may include a conductive layer.

As an example, when the second coil pattern 212 and the via 220 are formed on the other surface of the internal insulating layer IL through a plating process, the second coil pattern 212 and the via 220 each may include a seed layer such as an electroless plating layer, and an electroplating layer, and the like. The electroplating layer may have a single-layer structure, or may have a multiple-layer structure. The electroplating layer having a multiple-layer structure may have a conformal film structure in which one of the electroplating layers is covered by the other electroplating layer, or may have a form in which one of the electroplating layers is disposed on one surface of the other plating layers. The seed layer of the second coil pattern 212 and the seed layer of the via 220 may be integrated with each other such that no boundary may be formed between the seed layers, but an exemplary embodiment thereof is not limited thereto.

As another example, referring to FIGS. 1 to 5, when the first coil pattern 211 and the first lead-out portion 231 disposed on a lower surface of the internal insulating layer IL, and the second coil pattern 212 and the second lead-out portion 232 disposed on an upper portion of the internal insulating layer IL are formed independently, and the coil portion 200 is formed by layering the first coil pattern 211, the first lead-out portion 231, the second coil pattern 212 and the second lead-out portion 232 on the internal insulating layer IL, the via 220 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layer process, and an inter-metallic compound layer (IMC layer) may be formed between the metal layer having a low melting point and the second coil pattern 212, for example.

Also, as an example, the first and second coil patterns 211 and 212 and the first and second lead-out portions 231 and 232 may respectively be formed on and protrude to a lower surface and an upper surface of the internal insulating layer IL as illustrated in FIGS. 4 and 5. As another example, the first coil pattern 211 and the first lead-out portion 231 may be formed on and protrude to the lower surface of the internal insulating layer IL, and the second coil pattern 212 and the second lead-out portion 232 may be buried in the upper surface of the internal insulating layer IL, and the upper surfaces of the second coil pattern 212 and the second lead-out portion 232 may be exposed to the upper surface of the internal insulating layer IL. In this case, a concave portion may be formed on an upper surface of the second coil pattern 212 and/or an upper surface of the second lead-out portion 232 such that the upper surface of the internal insulating layer IL may not be coplanar with the upper surface of the second coil pattern 212 and/or the upper surface of the second lead-out portion 232.

The first and second coil patterns 211 and 212, the first and second lead-out portions 231 and 232, and the via 220 each may be formed of a conductive material such as aluminum (Al), silver (Ag), tin (Sn), gold (Au), nickel (Ni), lead (Pb), titanium (Ti), or alloys thereof, but an example of the material is not limited thereto.

A lower insulating layer 640 and a first external insulating layer 610 may respectively be on one surface and the other surface of the body 100, respectively. For example, referring to FIGS. 1 to 5, the first external insulating layer 610 may be disposed on the fifth surface of the body 100, and the lower insulating layer 640 may be disposed on the sixth surface of the body 100. In one embodiment, the lower insulating layer 640 may be disposed on the entire surface of the one surface or the fifth surface of the body 100. In one embodiment, the lower insulating layer 640 may be disposed on a part of the one surface or the fifth surface of the body 100. In one embodiment, the first external insulating layer 610 may be disposed on the entire surface of the other surface or the sixth surface of the body 100. In one embodiment, the first external insulating layer 610 may be disposed on a part of the other surface or the sixth surface of the body 100.

The lower insulating layer 640 and the first external insulating layer 610 each may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like.

The lower insulating layer 640 and the external insulating layer 610 each may have a thickness of 10 nm to 100 μm. When thicknesses of the lower insulating layer 640 and the first external insulating layer 610 are lower than 10 nm, properties of the coil component such as a Q factor, and the like, may be reduced. When thicknesses of the lower insulating layer 640 and the first external insulating layer 610 are greater than 100 μm, an overall length, width, and thickness of the coil component may increase such that it may be difficult to reduce a size of the coil component. In one embodiment, the thickness of the lower insulating layer 640 is 50 nm, 100 nm, 500 nm, 1 μm, or 50 μm. In one embodiment, the thickness of the external insulating layer 610 is 50 nm, 100 nm, 500 nm, 1 μm, or 50 μm.

The lower insulating layer 640 and the first external insulating layer 610 each may be formed by layering an insulating film such as an Ajinomoto build-up film on the sixth surface 106 and the fifth surface 105 of the body 100, but an exemplary embodiment thereof is not limited thereto. The lower insulating layer 640 and the first external insulating layer 610 each may also be formed by layering a photosensitive insulating material such as a dry film. As another example, the lower insulating layer 640 may be formed by disposing an intermediate material in which a metal film is formed, such as a resin coated copper (RCC), on one surface of an insulating film such that the other surface of the insulating film faces the sixth surface 106 of the body 100, and layering the intermediate material. In this case, the metal film of the intermediate material may become first to third terminal electrodes 320, 420, and 520 of the first to third external electrodes 300, 400, and 500 after going through a selective removal process. Also, the first external insulating layer 610 may be formed by disposing an intermediate material in which a metal film is formed, such as a resin coated copper (RCC), on one surface of an insulating film such that the other surface of the insulating film faces the fifth surface 105 of the body 100, and layering the intermediate material. In this case, the metal film of the intermediate material may become a first shielding layer 710.

The first shielding layer 710 may be disposed on the first external insulating layer 610 disposed on the fifth surface 105 of the body 100. In one embodiment, the first shielding layer 710 may be disposed on an entire surface of the first external insulating layer 610. In one embodiment, the first shielding layer 710 may be partially disposed on the first external insulating layer 610. The first shielding layer 710 may reduce a magnetic flux leakage leaking externally from the coil component according to the exemplary embodiment.

The first shielding layer 710 may include at least one of a conductive material and/or at least one of a magnetic material. For example, the conductive material may be a metal or an alloy including one or more materials selected from a group consisting of copper (Cu), aluminum (Al), iron (Fe), silicon (Si), boron (B), chromium (Cr), niobium (Nb), and nickel (Ni), or may be Fe—Si or Fe—Ni. Also, the first shielding layer 710 may include one or more materials selected from a group consisting of a ferrite, a permalloy, and an amorphous ribbon. The first shielding layer 710 may have a double-layer structure having a layer including the conductive material and a layer including a magnetic material, or may have a single-layer structure including the conductive material and/or a magnetic material.

The first shielding layer 710 may include two or more separate fine structures. For example, the first shielding layer 710 may be formed of an amorphous ribbon sheet divided into a plurality of pieces isolated from one another.

The first shielding layer 710 may be formed by layering an insulating film such as an Ajinomoto build-up film on the fifth surface 105 of the body 100, but an exemplary embodiment thereof is not limited thereto. As an example, the first shielding layer 710 may be formed by layering an intermediate material in which a metal film is formed, such as a resin coated copper (RCC), on one surface of the insulating film such that the other surface of the insulating film faces the fifth surface 105 of the body 100, or by layering an intermediate material in which a magnetic film is formed on one surface of the insulating film such that the other surface of the insulating film faces the fifth surface 105 of the body 100, the first shielding layer 710 may be formed along with the first external insulating layer 610. Alternatively, the first shielding layer 710 may also be formed on the first external insulating layer 610 by layering an insulating film such as an ABF on the fifth surface 105 of the body 100 and layering a shield film including a conductive material and/or a magnetic material.

The first shielding layer 710 may have a thickness of 10 nm to 100 μm. When thicknesses of the first shielding layer 710 are lower than 10 nm, properties of the coil component such as a Q factor, and the like, may be reduced. When thicknesses of the first shielding layer 710 are greater than 100 μm, an overall length, width, and thickness of the coil component may increase such that it may be difficult to reduce a size of the coil component. In one embodiment, the thickness of the first shielding layer 710 is 50 nm, 100 nm, 500 nm, 1 μm, or 50 μm.

The first and second external electrodes 300 and 400 may be connected to the coil portion 200. The first external electrode 300 may be connected to the first lead-out portion 231, and the second external electrode 400 may be connected to the second lead-out portion 232. The first external electrode 300 may include the first terminal electrode 320 disposed on the sixth surface 106 of the body 100, and a first connection electrode 310 disposed on the third surface 103 of the body 100 and connecting the first terminal electrode 320 to the first lead-out portion 231. The second external electrode 400 may include the second terminal electrode 420 disposed on the sixth surface 106 of the body 100, and the second connection electrode 410 disposed on the third surface 103 of the body 100 and connecting the second terminal electrode 420 to the second lead-out portion 232. In the exemplary embodiment, the lower insulating layer 640 may be disposed on the sixth surface 106 of the body 100, and thus, the first and second terminal electrode 320 and 420 may be disposed on the lower insulating layer 640.

The first and second terminal electrode 320 and 420 may be formed by selectively removing the metal film formed on the sixth surface 106 of the body 100. When the first and second terminal electrode 320 and 420 are formed of a plurality of layers, the first and second terminal electrode 320 and 420 may include layers formed by selectively removing the metal film. For example, when the above described RCC is used, the first and second terminal electrode 320 and 420 may be formed by selectively removing a copper film of the RCC. With regard to the copper film, a surface roughness of one surface being in contact with the insulting film may be lower than a surface roughness of the other surface opposing one surface. Thus, when the first and second terminal electrode 320 and 420 are formed using the RCC, as the surface roughness of the lower surfaces of the first and second terminal electrode 320 and 420, mounting surfaces of the coil component 1000, is relatively low, the first and second terminal electrode 320 and 420 may be formed to be planar.

The first and second connection electrodes 310, 410 may be formed by a vapor deposition process such as a sputtering process, or may be formed by a paste printing process, or the like.

The external electrodes 300 and 400 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The external electrodes 300 and 400 may be formed of a single layer or multiple layers. For example, the first and second terminal electrode 320 and 420 of the first and second external electrodes 300 and 400 may be formed in order on the lower insulating layer 640, and may be formed of three layers including copper (Cu), nickel (Ni), and tin (Sn), but an exemplary embodiment thereof is not limited thereto.

The third external electrode 500 may include a third terminal electrode 520 disposed on the sixth surface 106 of the body 100, and a third connection electrode 510 disposed on the third surface 103 of the body 100 and the first external insulating layer 610 and connecting the third terminal electrode 520 to the first shielding layer 710. The third external electrode 500 may be spaced apart from the first and second external electrodes 300 and 400 and may not be electrically connected to the first and second external electrodes 300 and 400.

The third terminal electrode 520 and the third connection electrode 510 may be formed by the process of forming the first and second terminal electrode 320 and 420 and the first and second connection electrodes 310 and 410 and may be formed of the materials forming the first and second terminal electrode 320 and 420 and the first and second connection electrodes 310 and 410.

When the coil component 1000 is mounted on a printed circuit board, the third terminal electrode 520 may be electrically connected to a ground of the printed circuit board, and the like. Thus, the third external electrode 500 may transfer electrical energy accumulated on the first shielding layer 710 to the printed circuit board.

A cover insulating layer 630 may cover the first shielding layer 710, the first to third connection electrodes 310, 410, and 510, the fifth surface 105 of the body 100, and the plurality of walls 101, 102, 103, and 104 of the body. In other words, a third shielding layer 730, which will be described later, may be disposed on the first to fifth surfaces 101, 102, 103, 104, and 105 of the body 100, and the cover insulating layer 640 may be disposed between the first to fifth surfaces 101, 102, 103, 104, and 105 and the third shielding layer 730 to not be electrically connected to the body 100 and the external electrodes 300, 400, and 500.

The cover insulating layer 630 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like.

The cover insulating layer 630 may have a thickness of 10 nm to 100 μm. When a thickness of the cover insulating layer 630 is lower than 10 nm, properties of a coil component such as a Q factor may reduce, and when a thickness of the cover insulating layer 630 is greater than 100 μm, an overall length, width, and thickness of the coil component may increase such that it may be difficult to reduce a size of the coil component. In one embodiment, the cover insulating layer 630 is 50 nm, 100 nm, 500 nm, 1 μm, or 50 μm. In one embodiment, the thickness of the external insulating layer 610 is 50 nm, 100 nm, 500 nm, 1 μm, or 50 μm.

The cover insulating layer 630 may be formed by layering an insulating film on each of the first to fifth surfaces 101, 102, 103, 104, and 105 of the body 100. Alternatively, the cover insulating layer 630 may be formed by depositing an insulating material on the first to fifth surfaces 101, 102, 103, 104, and 105 of the body 100 by a vapor deposition process such as chemical vapor deposition.

The third shielding layer 730 may be disposed on the cover insulating layer 630, and may be disposed on each of the first to fifth surfaces 101, 102, 103, 104, and 105 of the body 100. The third shielding layer 730 may be disposed on surfaces of the body 100 except for the sixth surface 106 of the body, and may reduce a magnetic flux leakage of the coil component 1000. Portions of the third shielding layer 730 respectively disposed on the first to fourth surfaces 101, 102, 103, and 104 of the body 100 may be configured such that ends of the portions of the third shielding layer 730 may not extend to each edge region between the sixth surface and the first to fourth surfaces 101, 102, 103, and 104 of the body.

The third shielding layer 730 may include at least one of a conductive material or a magnetic material. For example, the conductive material may be a metal or an alloy including one or more materials selected from a group consisting of copper (Cu), aluminum (Al), iron (Fe), silicon (Si), boron (B), chromium (Cr), niobium (Nb), nickel (Ni) or alloys thereof, or may be Fe—Si or Fe—Ni. Also, the third shielding layer 730 may include one or more materials selected from a group consisting of a ferrite, a permalloy, and an amorphous ribbon. The third shielding layer 730 may have a double-layer structure having a layer including the conductive material and a layer including a magnetic material, or may have a single-layer structure including the conductive material and/or a magnetic material.

The third shielding layer 730 may include two or more microstructures isolated from each other. For example, the third shielding layer 730 may be formed of amorphous ribbon sheets divided into a plurality of pieces and isolated from one another.

The third shielding layer 730 may be formed through a vapor deposition process such as a sputtering process, but an exemplary embodiment thereof is not limited thereto.

A cover layer 800 may be formed on the first to fifth surfaces 101, 102, 103, 104, and 105 and may cover the third shielding layer 730. The cover layer 800 may cover ends of portions of the third shielding layer 730 disposed on the first to fourth surfaces 101, 102, 103, and 104 of the body 100.

In other words, the cover layer 800 may cover the third shielding layer 730 along with the cover insulating layer 630.

The cover layer 800 may be formed through a vapor deposition process, or the like, but an exemplary embodiment thereof is not limited thereto. The cover layer 800 may include a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and silicon oxide (SiOx) or silicon nitride (SiNx).

Although not illustrated, the coil component 1000 according to the exemplary embodiment may further include an insulating film formed along surfaces of the first and second coil patterns 211 and 212, the first and second lead-out portions 231 and 232, and the internal insulating layer IL. The insulating film may protect the first and second coil patterns 211 and 212 and the first and second lead-out portions 231 and 232, may insulate the first and second coil patterns 211 and 212 and the lead-out portions 231 and 232 from the body 100, and may include a well-known insulating material. The insulating material included in the insulating film is not limited to any particular material. The insulating film may be formed by a vapor deposition process, or the like, but an exemplary embodiment thereof is not limited thereto. The insulating film may also be formed by layering an insulating film on both surfaces of the internal insulating layer IL.

The cover insulating layer 630 and the cover layer 800 may be directly disposed in the coil component in the exemplary embodiment, and thus, the cover insulating layer 630 and the cover layer 800 may be distinct from a molding material for molding a coil component and a printed circuit substrate in a process of mounting the coil component on the printed circuit board. For example, the cover insulating layer 630 and the cover layer 800 may not be in contact with a printed circuit substrate, differently from a molding material. Also, the cover insulating layer 630 and the cover layer 800 may not be supported by or fixed to a printed circuit substrate, differently from a molding material. Further, differently from a molding material surrounding a connection member such as a solder ball which connects a coil component with a printed circuit substrate, the cover insulating layer 630 and the cover layer 800 may not surround a connection member. As the cover insulating layer 630 and the cover layer 800 are not molding materials formed by heating an epoxy molding component, and the like, flowing the epoxy molding component onto a printed circuit board and performing a curing process, it may not be necessary to consider a void occurring during a process of forming a molding material or warpage of a printed circuit board caused by a difference in coefficients of thermal expansion between a molding material and a printed circuit board.

Also, the first to third shielding layers 710 and 730 may be directly disposed in the coil component in the exemplary embodiment, and thus, the first to third shielding layers 710 and 730 may be distinct from a shielding can, and the like, which is coupled to a printed circuit board to shield EMI after mounting the coil component on a printed circuit board. For example, the first to third shielding layers 710 and 730 may not require a fixing member for fixing the first to third shielding layers 710 and 730 to a printed circuit board, and may not be directly in contact with a printed circuit board, differently from a general shielding can. In one embodiment, the coil component of the present invention may have more than three shielding layers.

Accordingly, in the coil component 1000 according to the exemplary embodiment, as the first to third shielding layers 710 and 730 are directly formed in the coil component 1000, a magnetic flux leakage occurring in a coil component may be shielded in an efficient manner. In other words, as electronic devices are reduced in size and have higher performances, the number of electronic components included in an electronic device and a distance between adjacent electronic components have been reduced recently. In the exemplary embodiment, each coil component is shielded such that a magnetic flux leakage occurring in coil components may be shielded effectively, thereby reducing sizes of electronic components and implementing high performance. Further, in the coil component 1000, the amount of an effective magnetic material may be increased in a shield region as compared to a configuration in which a shielding can is used, thereby improving properties of the coil component.

Also, in the coil component 1000 according to the exemplary embodiment, a size of the coil component may be significantly reduced while implementing an electrode structure in a lower portion. In other words, a general coil component may have a width smaller than a length, whereas, in the exemplary embodiment, the coil component may be configured such that the first and second lead-out portions 231 and 232, both ends of the coil portion 200, may not respectively be exposed to both front and rear surfaces 101 and 102 of the body 100 opposing each other in a length direction, but may be exposed to both surfaces 103 and 104 of the body 100 opposing each other in a width direction. Accordingly, even when external electrodes are formed, a length of the coil component may not increase. Also, the first and second lead-out portions 231 and 232, both ends of the coil portion 200, may be exposed to one surface 103 between the both surfaces 103 and 104 of the body 100, and external electrodes may not be necessarily formed on the other surface 104 of the body 100, thereby significantly reducing an increase in width.

Second Embodiment

Figure 7:
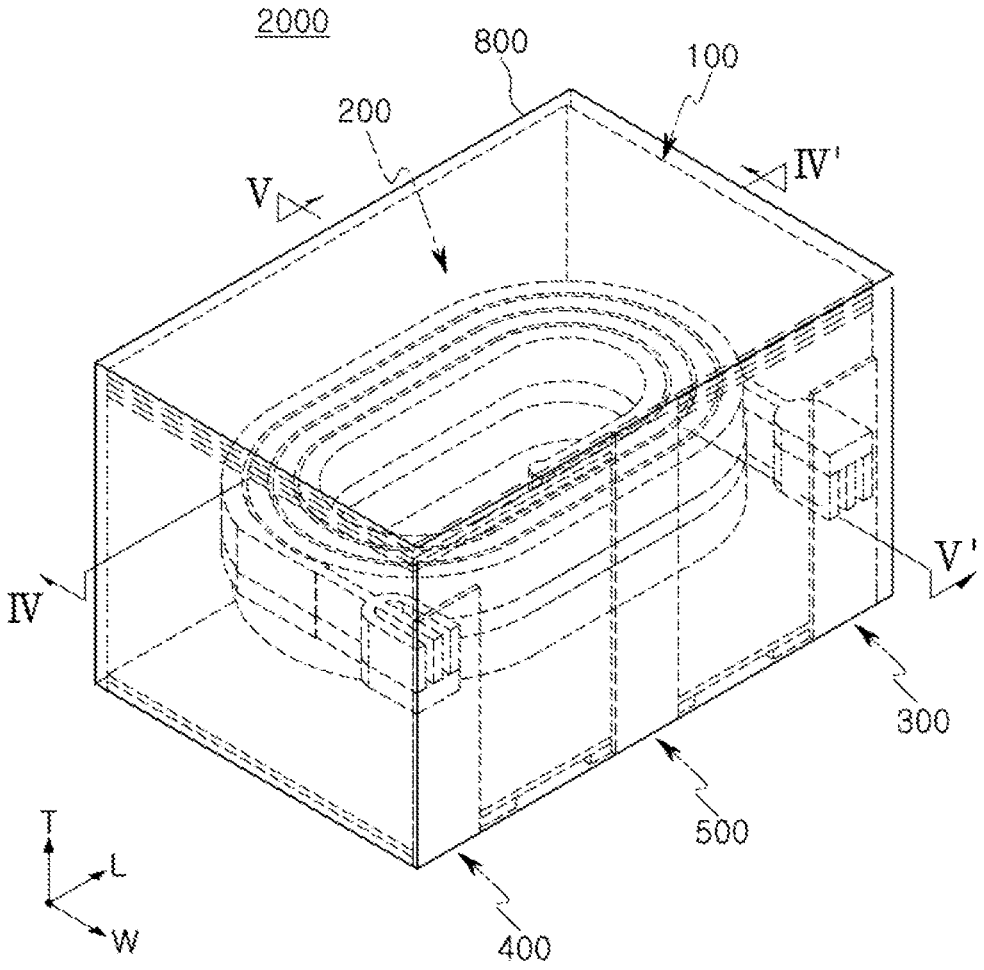
FIG. 7 is a diagram illustrating a coil component according to another exemplary embodiment in the present disclosure.
Figure 8:
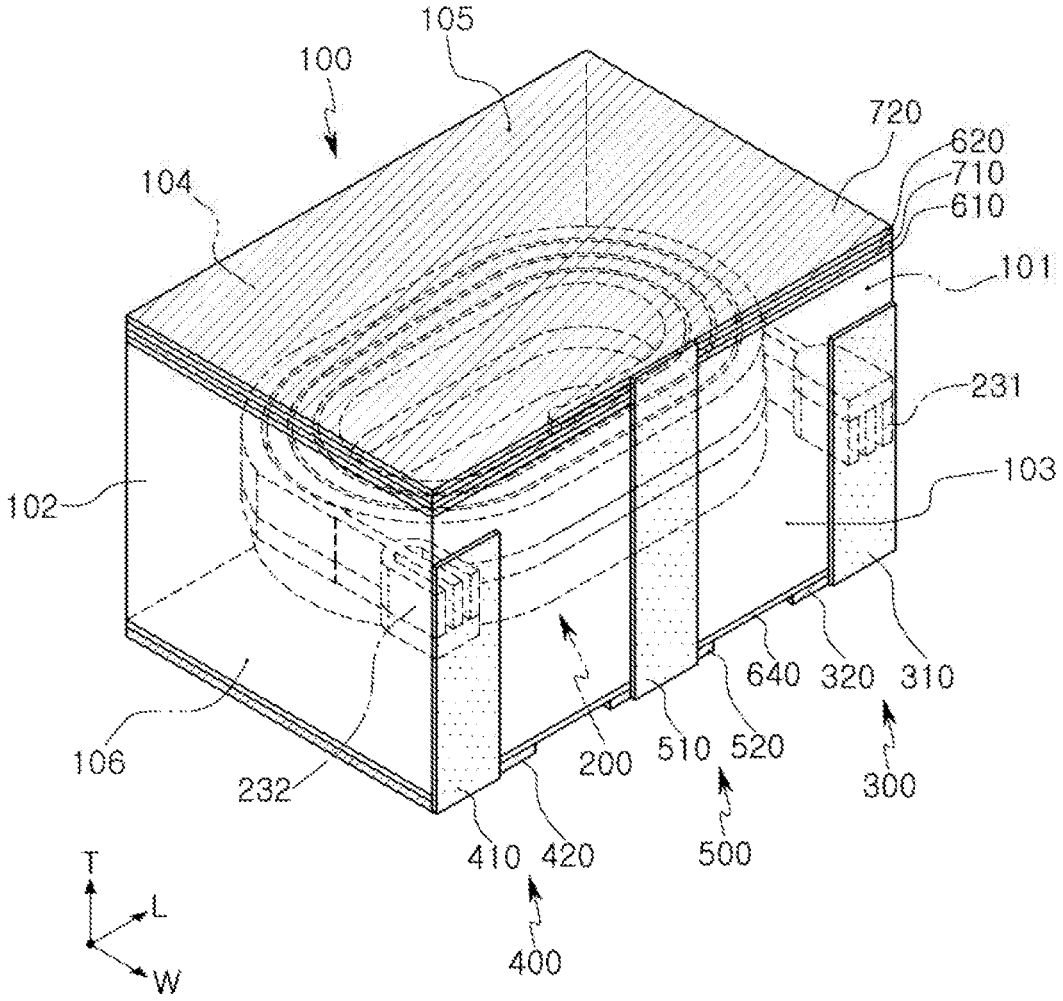
FIG. 8 is a diagram illustrating a coil component in which some of elements illustrated in FIG. 7 are omitted.
Figure 9:
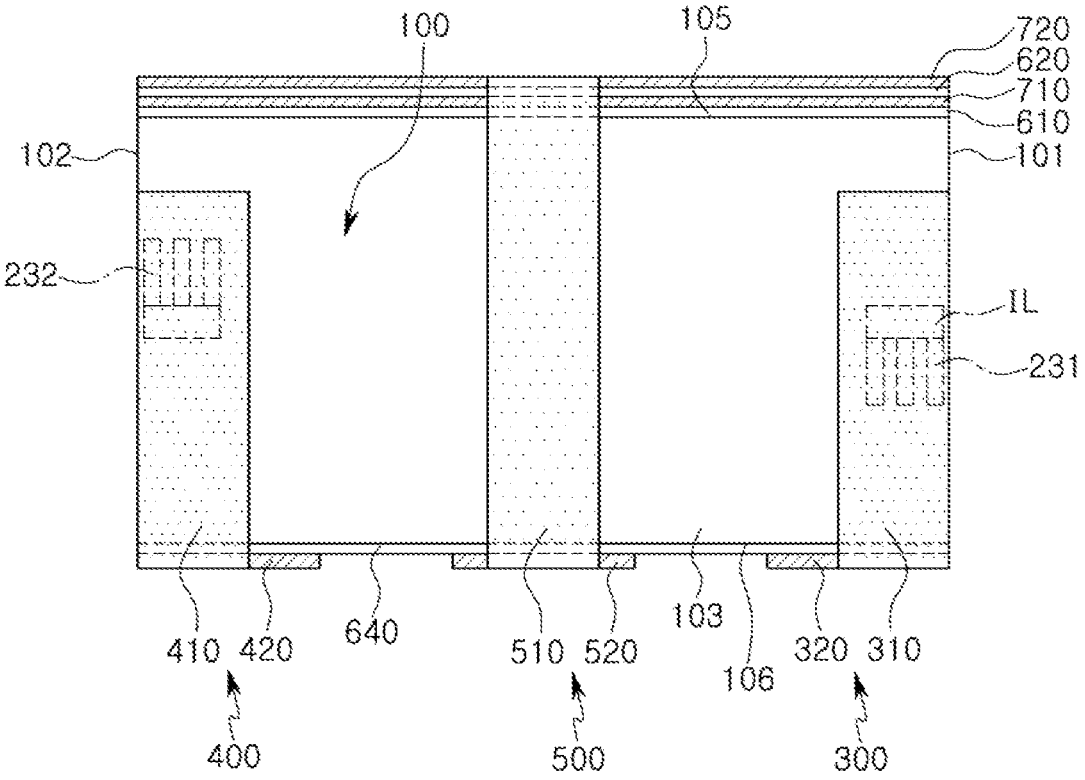
FIG. 9 is a diagram illustrating a third surface of a body illustrated in FIG. 8.
Figure 10:
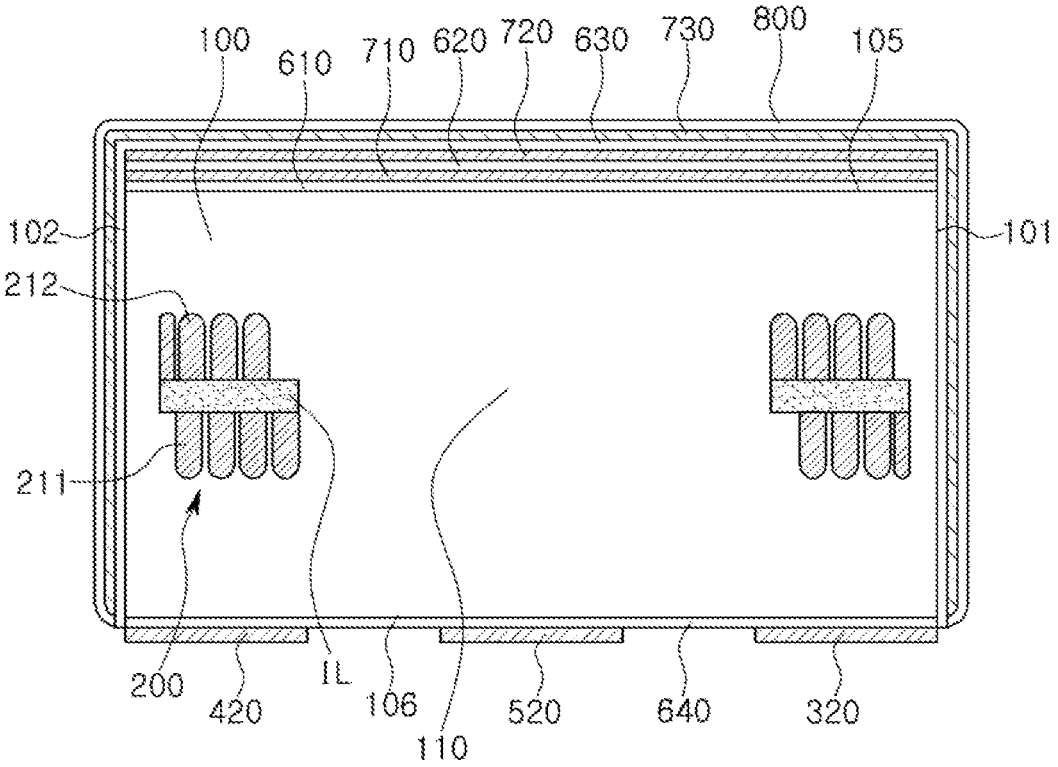
FIG. 10 is a cross-sectional diagram taken along line IV-IV' in FIG. 7.
Figure 11:
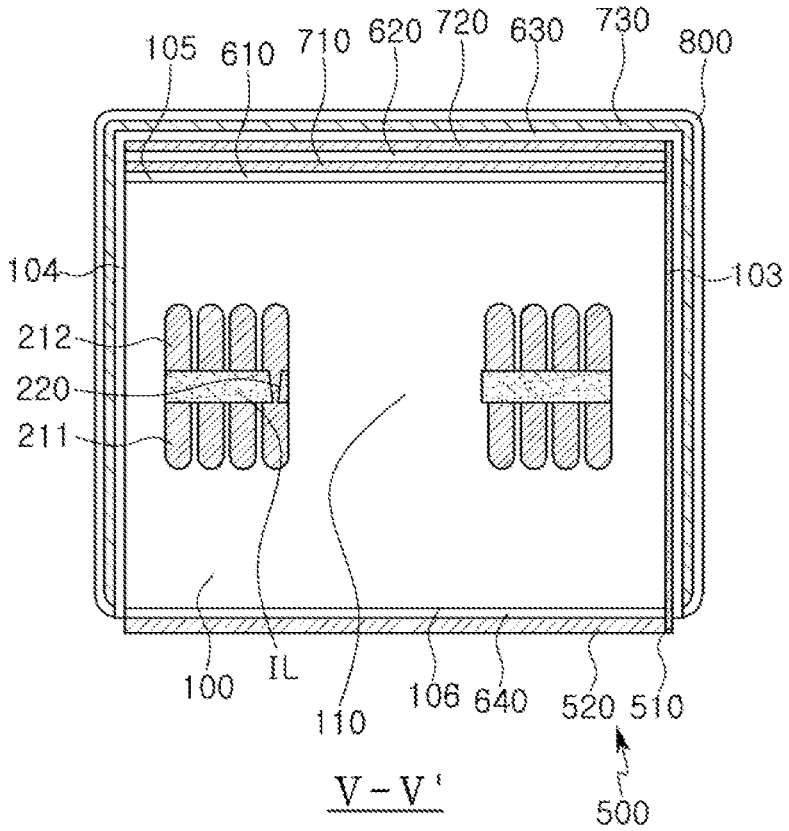
FIG. 11 is a cross-sectional diagram taken along line in V-V'.

FIG. 7 is a diagram illustrating a coil component according to another exemplary embodiment. FIG. 8 is a diagram illustrating a coil component in which some of elements illustrated in FIG. 7 are omitted. FIG. 9 is a diagram illustrating a third surface of a body illustrated in FIG. 8. FIG. 10 is a cross-sectional diagram taken along line IV-IV' in FIG. 7. FIG. 11 is a cross-sectional diagram taken along line in V-V'. With regard to FIG. 8, FIG. 8 illustrates an exemplary embodiment of a coil component in which the cover insulating layer 630, the third shielding layer 730, and the cover layer 800 are omitted.

Referring to FIGS. 1 to 11, a coil component 2000 according to an exemplary embodiment may further include a second external insulating layer 620 and a second shielding layer 720, as compared to the coil component 1000 described in the aforementioned exemplary embodiment. Thus, in the exemplary embodiment, a second external insulating layer 620 and a second shielding layer 720, which are not described in the aforementioned exemplary embodiment, will be described. With regard to the other elements in the exemplary embodiment, the descriptions of the elements described in the aforementioned exemplary embodiment may be similarly applied.

The second shielding layer 720 may be disposed on the first shielding layer 710. For example, in the exemplary embodiment, the first shielding layer 710 may include a conductive material, and the second shielding layer 720 may include a magnetic material. The first shielding layer 710 may be formed of a metal film such as a copper film, and the second shielding layer 720 may be formed of a shield film including a ferrite, and the like.

The second external insulating layer 620 may be disposed between the first shielding layer 710 and the second shielding layer 720. Accordingly, in the exemplary embodiment, on the fifth surface 105 of the body 100, a first external insulating layer 610, a first shielding layer 710, a second external insulating layer 620, and a second shielding layer 720 may be disposed in order.

A third connection electrode 510 of a third external electrode 500 in the exemplary embodiment may be disposed on the third surface 103 of the body 100, the first external insulating layer 610, the first shielding layer 710, the second external insulating layer 620 and the second shielding layer 720. Thus, the first and second shielding layer 710 and 720 may be electrically connected to the third terminal electrode 520.

In the exemplary embodiment, both of a reflective shielding effect by the first shielding layer 710 and an absorption shielding effect by the second shielding layer 720 may be implemented. In other words, in a lower frequency band of 1 MHz or lower, a magnetic flux leakage may be absorbed and shielded using the second shielding layer 720, and in a high frequency band higher than 1 MHz, a magnetic flux leakage may be reflected and shielded using the first shielding layer 710. Thus, the coil component 2000 according to the exemplary embodiment may shield a magnetic flux leakage in a relatively broad frequency band.

Meanwhile, in the exemplary embodiment, differently from the above described example, the first shielding layer 710 may include a magnetic material, and the second shielding layer 720 may include a conductive material.

According to the aforementioned exemplary embodiments, a size of a coil component may be reduced.

Also, according to the aforementioned exemplary embodiments, an electrode structure on a lower surface may be easily formed on a lower surface of a coil component.

Further, according to the aforementioned exemplary embodiment, a shielding structure may be easily formed.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having one surface and another surface opposing each other in one direction, and a plurality of walls each connecting the one surface to the another surface;

a coil portion buried in the body, and having both ends exposed to a same wall among the plurality of walls of the body and spaced apart from respective walls among the plurality of walls which are adjacent to the same wall;

first and second external electrodes respectively including first and second terminal electrodes disposed on the one surface of the body and spaced apart from each other, and first and second connection electrodes respectively connecting the first and second terminal electrodes to the both ends of the coil portion;

a first external insulating layer disposed on the another surface of the body; and a first shielding layer disposed on the first external insulating layer, wherein the both ends, at least one of which has a plurality of slits, are exposed to the same wall in another direction perpendicular to the one direction such that an entire remaining part of the coil portion is spaced apart from the same wall in the another direction.

2. The coil component of claim 1, wherein the first shielding layer includes at least one of a magnetic material and/or a conductive material.

3. The coil component of claim 1, further comprising:

a third external electrode including a third terminal electrode disposed on the one surface of the body, and a third connection electrode disposed on one wall of the body and on the first external insulating layer and thereby connecting the third terminal electrode and the first shielding layer to each other, and spaced apart from the first and second external electrodes.

4. The coil component of claim 3, further comprising:

a cover insulating layer covering the first shielding layer, the first to third connection electrodes, the another surface of the body, and the plurality of walls of the body.

5. The coil component of claim 1, wherein the first shielding layer includes a conductive material, and the coil component further includes a second shielding layer disposed on the first shielding layer, wherein the second shielding layer includes a magnetic material.

6. The coil component of claim 5, further comprising:

a second external insulating layer disposed between the first shielding layer and the second shielding layer.

7. The coil component of claim 6, further comprising:

a third external electrode including a third terminal electrode disposed on the one surface of the body, and a third connection electrode disposed on one wall of the body and on the first and second external insulating layers and connecting the third terminal electrode and the first and second shielding layers to each other, and spaced apart from the first and second external electrodes.

8. The coil component of claim 7, further comprising:

a cover insulating layer covering the first and second shielding layers, the first to third connection electrodes, the another surface of the body, and the plurality of walls of the body.

9. The coil component of claim 8, further comprising:

a third shielding layer disposed on the cover insulating layer, and disposed on the another surface of the body and on the plurality of walls of the body.

10. A coil component, comprising:

a body including a resin and a magnetic metal powder dispersed in the resin, and having one surface and another surface opposing each other in one direction and a plurality of walls connecting the one surface and the another surface;

a coil portion including a coil pattern forming at least one turn centering on an axis in the one direction, and first and second lead-out portions extending from the coil pattern and exposed to a same wall among the plurality of walls of the body and spaced apart from respective walls among the plurality of walls which are adjacent to the same wall, and buried in the body;

a shielding layer disposed on the another surface of the body;

first and second external electrodes disposed on one wall of the body and spaced apart from each other, respectively connected to the first and second lead-out portions and extending to the one surface of the body; and a third external electrode disposed on one wall of the body and spaced apart from the first and second external electrodes, connected to the shielding layer, and extending to the one surface of the body, wherein the first and second lead-out portions, at least one of which has a plurality of slits, are exposed to the same wall in another direction perpendicular to the one direction such that an entire remaining part of the coil portion is spaced apart from the same wall in the another direction.

11. The coil component of claim 1, wherein the first external insulating layer has a thickness of 10 nm to 100 μm.

12. The coil component of claim 1, wherein the first shielding layer has a double-layer structure having a layer including a conductive material and a layer including a magnetic material.

13. The coil component of claim 7, wherein the first and second shielding layers are electrically connected to the third terminal electrode.

14. The coil component of claim 1, further comprising: a lower insulating layer disposed on the one surface of the body.

15. The coil component of claim 14, wherein the lower insulating layer includes a thermoplastic resin or thermosetting resin.

16. The coil component of claim 14, wherein the lower insulating layer has a thickness of 10 nm to 100 μm.

* * * * *